US005722129A

United States Patent [19]

Harrison et al.

[11] Patent Number: 5,722,129

[45] Date of Patent: Mar. 3, 1998

[54] SEAT BELT BUCKLE

[75] Inventors: Mark John Harrison; Cecil Owens; Michael John Jackson, all of Belfast, United Kingdom

[73] Assignee: European Components Co. Limited, United Kingdom

[21] Appl. No.: 796,604

[22] Filed: Feb. 7, 1997

Related U.S. Application Data

[63] Continuation of Ser. No. 573,431, Dec. 15, 1995.

[30] Foreign Application Priority Data

Dec. 23, 1994 [GB] United Kingdom ..... 9426119

[51] Int. Cl.[6] ..... A44B 11/00

[52] U.S. Cl. ..... 24/642; 24/635; 24/637

[58] Field of Search ..... 24/642, 633, 635, 24/637, 655, 323

[56] References Cited

U.S. PATENT DOCUMENTS

| | | | |
|---|---|---|---|
| 3,585,692 | 6/1971 | Le Mire | 24/635 |
| 4,035,877 | 7/1977 | Brownson et al. | 24/323 |
| 4,368,563 | 1/1983 | Lentz | 24/637 |
| 4,577,378 | 3/1986 | Harenberg | 24/635 |
| 4,597,141 | 7/1986 | Wier | 24/642 |
| 5,213,365 | 5/1993 | Fohl | 24/633 |

FOREIGN PATENT DOCUMENTS

| | | | |
|---|---|---|---|
| 2 621 229 | 10/1988 | European Pat. Off. . | |
| 0 360 154 | 3/1990 | European Pat. Off. . | |
| 3334767 | 4/1984 | Germany | 24/633 |
| 1-223902 | 9/1989 | Japan . | |
| 1123686 | 8/1968 | United Kingdom . | |

*Primary Examiner*—Victor N. Sakran
*Attorney, Agent, or Firm*—Lyon, P.C.

[57] ABSTRACT

A buckle for a seat belt of a motor vehicle includes a release button (24) which is provided to release the latch plate from the locking means. A resilient protrusion or protrusions on the button presses the latch plate, when inserted in the buckle, against the frame of the buckle thereby reducing the tendency of the latch plate and frame to rattle against each other and consequently the noise generated by vibration of the buckle is reduced.

7 Claims, 1 Drawing Sheet

SEAT BELT BUCKLE

Figure 1:
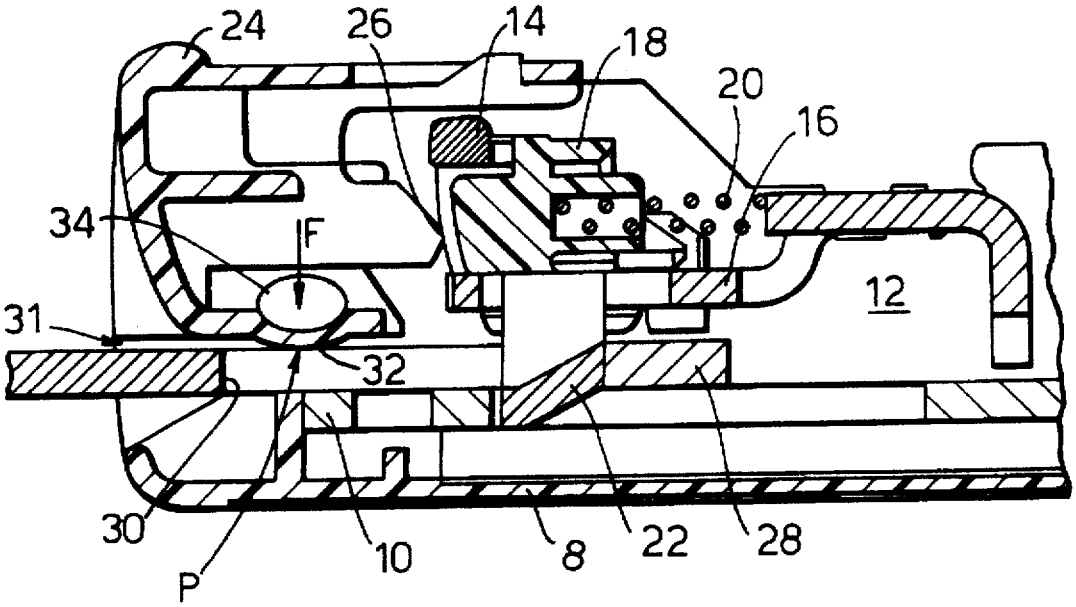

This application is a continuation of copending application Ser. No. 08/573,431 filed on Feb. 15, 1995.

The present invention relates to a buckle for seat belts in motor vehicles.

Seat belt buckles are well known in which a latch plate attached to a seat belt can be inserted into a slot in the buckle. The seat belt and buckle are secured to the vehicle bodywork. A locking member in the buckle releasably engages an aperture in the latch plate to prevent the latch plate coming out of the buckle, in particular in a motor accident, thereby restraining the occupant of the seat. Pressing on a release button of the buckle disengages the locking member from the latch plate and enables the latch plate to be released from the buckle and the seat belt to be removed from the occupant.

A conventional buckle, such as disclosed in EP-B-0452464, comprises a rigid frame including a base, upstanding side walls adapted to guide the latch plate longitudinally of the frame, a bar extending transversely of the frame between said side walls, said bar being spaced above the base, a locking member pivotally mounted on the frame and pivotal between a lower latched position and an upper unlatched position, said locking member carrying a downwardly projecting locking element engageable in said aperture in the latch plate to retain the latch plate in place, a slider is slidable longitudinally of the locking member between a first position in which it is located under said bar, to retain the locking member in the lower latched position and a second position in which it allows said locking member to pivot to its upper unlatched position, and a slider spring urges the slider towards its first position.

A release button is provided to push the slider to its second position, the slider being resiliently engaged by the slider spring against the rear of the bar to retain the locking member in its upper unlatched position. On inserting the latch plate into the slot of the buckle the slider is released so that the slider spring may urge it to its first position under the bar and the locking member may pivot to its lower latched position engaging the aperture in the latch plate.

The provision of the bar extending over the slider assists in the withstanding of heavy loads and prevents inadvertent release of the buckle.

When the latch plate has been inserted into the slot in the buckle, the locking member secures the latch plate from being withdrawn in the direction of the slot, but the latch plate still has some freedom of motion inside the slot, for example across the thickness of the slot. There are vibrations in a motor vehicle and these can cause the latch plate to rattle against the frame of the buckle inside the slot. The latch plate and frame, being made typically of metal, produce a rattling noise which is irritating to the occupants of the vehicle, and the vibrations also cause additional wear to the components.

GB-A-1123686 teaches an arrangement in which a spring arm is engaged by the end of the latch plate as it is inserted. U.S. Pat. No. 4,577,378 has a pair of complex springs engaged by the shoulders of the latch plate, again acting on the relatively thin edge of the plate. U.S. Pat. No. 4,597,141 has plastic cantilevered lips, which engage the top and bottom major surfaces of the latch plate.

While all these attempt to reduce rattling of the latch plate, for various reasons, they are not entirely satisfactory.

It is therefore an object of the present invention to reduce the noise caused by the latch plate rattling against the frame of the buckle.

According to the present invention there is provided a buckle for a seat belt of a motor vehicle, said buckle comprising a frame, a latch member insertable in said frame, an aperture in said latch plate, a locking member engageable in said aperture in said latch plate, a release button for releasing said locking member and hence releasing said latch plate, said buckle having an elongate slot into which said latch plate may be inserted, wherein at least one inner surface of said slot is defined by said frame, wherein at least one protrusion made of a resilient material is formed integrally with said release button and forms an opposite surface of said slot to said frame, and wherein said at least one protrusion projects laterally into the slot, whereby said at least one protrusion is deflected by said latch plate as it is inserted into the slot, and urges the latch plate resiliently against the frame of the buckle.

With such a structure, the resilient engagement of the latch plate against the protrusion(s) prevents any rattling of the latch plate.

The protrusion(s) are formed integrally with the release button of the buckle thereby making it cheap to manufacture a buckle possessing the advantages of the invention, without the need for additional parts.

A specific embodiment of the invention will now be described by way of example with reference to the sole accompanying drawing, FIG. 1, which shows a cross-section of a buckle with a latch plate inserted.

Referring to the drawing, which illustrates a buckle similar to that disclosed in EP-0452464B. The buckle consists of a lower cover 8 and a channel section frame 10 having side walls 12 which are joined by a locking bar 14. Pivotally mounted between the side walls 12 is a locking lever 16 on which is slidably mounted a plastics material slider 18, which is urged to the left by a slider spring 20. The locking lever 16 carries a downwardly extending locking member 22.

Also axially slidable relative to the frame 10 is a plastics material release button 24, including an abutment 26 engageable with the slider 18, so that when the release button is pushed to the right, as seen in the drawing, the slider may be disengaged from under the bar 14, whereupon the lever will pivot clockwise under the action of a spring (not shown). Between the lower surface of the release button and the facing upper surface of a portion of the frame there is found an elongate slot 31 into which may be inserted a latch plate 28 having an aperture 30. The locking member 22 is shown engaged in this aperture and is normally retained by the action of the bar 14 preventing movement of the lever 16. When the release button 24 is moved to the right, the lever 16 will pivot thereby disengaging the locking member 22 from the aperture, whereupon the latch plate can either be removed by pulling on the belt or, more normally, the latch plate is ejected by a spring loaded ejector (not shown).

According to the invention the portion of the inner surface of the slot formed by part of the release button 24 has two protrusions 32 which project into the path of the latch plate. During insertion of the latch plate, the protrusions are deflected by contact with a face of the latch plate, the protrusions contact the latch plate one on each side of the aperture. The protrusions and release button, being made of a resilient material, bias the latch plate 28 against the frame 10 by a force F acting at points P. Since the latch plate 28 is pressed against the frame 10 they do not rattle against each other and the noise produced by vibration of the buckle is greatly reduced.

The release button 24 may be conveniently manufactured by a moulding process in which a mould core of the form of a bar is included behind the position of the protrusions. Corresponding hollows in the mould form rib-shaped protrusions on the finished release button. The voids left by the bar-shaped mould core in the side walls of the release button are indicated in the Figure by the elliptical line 34.

We claim:

1. A buckle for a seat belt of a motor vehicle, said buckle comprising a frame, a latch plate insertable in said frame, an aperture in said latch plate, a locking member engageable in said aperture in said latch plate, a release button for releasing said locking member and hence releasing said latch plate, said buckle having an elongate slot into which said latch plate is inserted, wherein at least one inner surface of said slot is defined by said frame, wherein at least one protrusion made of a resilient material is formed integrally with a portion of said release button extending parallel to said slot and forming an opposite surface thereof relative to said frame, and wherein said protrusion projects laterally into the slot, whereby said protrusion is deflected by said latch plate as it is inserted into the slot, and urges the latch plate resiliently against the frame of the buckle.

2. A buckle according to claim 1, wherein said at least one protrusion projects from at least one broad inner surface of said elongate slot.

3. A buckle according to claim 2, wherein two protrusions are provided on said inner surface, said protrusions being positioned to engage the latch plate, one on each side of the aperture as the latch plate is inserted into the slot.

4. A buckle according to claim 3, wherein the protrusion is rib shaped.

5. A buckle according to claim 2, wherein the protrusion is rib shaped.

6. A buckle according to claim 1, wherein two protrusions are provided on said inner surface, said protrusions being positioned to engage the latch plate, one on each side of the aperture as the latch plate is inserted into the slot.

7. A buckle according to claim 1, wherein the protrusion is rib shaped.

* * * * *